US010618098B2

(12) United States Patent
Yang et al.

(10) Patent No.: US 10,618,098 B2
(45) Date of Patent: Apr. 14, 2020

(54) SERVO-ROTATING ALL-FUNCTION TOOL MODULE FOR USE WITH SPRING FORMING MACHINE

(71) Applicant: Union Precision Hardware Co., Ltd., Huizhou (CN)

(72) Inventors: Yao Ming Yang, New Taipei (TW); Neng Wen Mao, Yuanjiang (CN); Hua Yun Hsin, Keelung (TW)

( * ) Notice: Subject to any disclaimer, the term of this patent is extended or adjusted under 35 U.S.C. 154(b) by 505 days.

(21) Appl. No.: 15/585,183

(22) Filed: May 3, 2017

(65) Prior Publication Data

US 2018/0085818 A1 Mar. 29, 2018

(30) Foreign Application Priority Data

Sep. 29, 2016 (TW) ..... 105214772 U
Jan. 13, 2017 (TW) ..... 106200705 U

(51) Int. Cl.

| | |
|---|---|
| ***B21F 3/02*** | (2006.01) |
| ***B21F 1/00*** | (2006.01) |
| ***B21F 3/06*** | (2006.01) |
| ***B21F 3/04*** | (2006.01) |
| ***B21F 35/00*** | (2006.01) |

(52) U.S. Cl.

CPC ..... *B21F 3/02* (2013.01); *B21F 1/006* (2013.01); *B21F 3/04* (2013.01); *B21F 3/06* (2013.01); *B21F 35/00* (2013.01)

(58) Field of Classification Search

CPC .... B21F 1/006; B21F 3/00; B21F 3/02; B21F 3/04; B21F 3/06; B21F 35/00

See application file for complete search history.

(56) References Cited

U.S. PATENT DOCUMENTS

| | | | | |
|---|---|---|---|---|
| 5,887,471 A * | 3/1999 | Itaya | B21F 3/00 | 72/135 |
| 6,142,002 A * | 11/2000 | Itaya | B21F 3/04 | 72/137 |
| 6,857,303 B2 * | 2/2005 | Latour | B21D 11/14 | 72/299 |
| 7,496,998 B2 * | 3/2009 | Itaya | B21F 3/02 | 29/33 F |
| 8,756,968 B2 * | 6/2014 | Etienne | B21F 35/00 | 72/145 |

(Continued)

FOREIGN PATENT DOCUMENTS

| | | |
|---|---|---|
| TW | M527355 U | 8/2016 |
| TW | M531337 U | 11/2016 |

*Primary Examiner* — Edward T Tolan

(57) ABSTRACT

A servo-rotating all-function tool module is provided for use with a spring forming machine and includes an axle rotating tool module and a servo transmission module assembly. The axle rotating tool module is rotatably mounted, in combination with an axle of the rotary axle assembly of the spring forming machine, to a front wall board and includes an oscillating base and a tool. The oscillating base is rotatably mounted to the rotary axle assembly. The tool is mounted to an end of the oscillating base. The servo transmission module assembly is mounted to the spring forming machine and includes a servo moving ring circumferentially surrounding the oscillating base for driving the oscillating base to oscillate in all directions to thereby cause the tool to press down or lift upward.

10 Claims, 15 Drawing Sheets

(56) References Cited

U.S. PATENT DOCUMENTS

| | | | | |
|---|---|---|---|---|
| 2004/0065130 | A1* | 4/2004 | Itaya | B21F 3/02 72/137 |
| 2008/0022742 | A1* | 1/2008 | Itaya | B21F 3/02 72/135 |
| 2014/0311204 | A1* | 10/2014 | Sigg | B21F 3/02 72/139 |

* cited by examiner

SERVO-ROTATING ALL-FUNCTION TOOL MODULE FOR USE WITH SPRING FORMING MACHINE

TECHNICAL FIELD OF THE INVENTION

The present invention relates generally to the field of spring forming machines, and more particularly to an all-function tool module that is drivable through rotation of a servo for being used with a spring forming machine.

DESCRIPTION OF THE PRIOR ART

A spring forming machine is a piece of machinery for making various types or models of springs. The manufacturing process is generally such that a feeding roller that is capable of clamping and holding a wire for making a spring, which will be referred to as a spring-making wire for simplicity, is used to feed the spring-making wire through a through hole formed in a front wall board of the machine to allow various tools that are mounted to the front wall board to approach and engage, in a sideway direction, the spring-making wire to conduct various operations, such as bending, twisting or looping, and cutting, in order to complete the manufacture of a spring. In addition, various programs are loaded in advance in a processor combined with the spring forming machine so that execution of these programs controls the wire feeding means and the tools mounted to the front wall board of the spring forming machine to conduct various operations, such as bending, twisting or looping, and cutting, which are necessary for different phases of the manufacturing operation to thereby achieve the purposes of making springs of various types and models.

The above-discussed existing spring forming machine is fully capable of achieving the purpose of making various sorts of springs. However, the number of the tools that are mounted to the front wall board is limited and the tools are allowed to do linear movements on the front wall board so that the movements of the tools approaching the spring-making wire are generally of the same angle and direction, making it not possible to suit the needs for bending and twisting or looping in all directions during the manufacturing of springs manufacturing. To cope with such a problem, spring forming machines that are capable of rotating the wires are available. Such a kind of spring forming machines, however, is expensive and may be incapable of performing desired operations due to the gauges of the sprig-making wires being small, so that such machines do not suit the need for contemporary need for making diverse forms of springs.

Further, Taiwan Utility Model Nos. M527355 and M531337 and Taiwan Utility Model Application No. 105214772 all disclose tool modules that provide a function of bending and twisting in all directions, yet at an expense of complication of structure, so that there is still a need for further improvement.

SUMMARY OF THE INVENTION

In view of the above problems, an objective of the present invention is to provide a servo-rotating all-function tool module for use with a spring forming machine, which comprises a tool that is mounted, in combination with an axle of a rotary axle assembly, to a front wall board of the spring forming machine, in a rotatable manner, such that rotation of the axle changes the direction that the tool takes to approach a wire thereby achieving a function that is generally achievable with a high-end spring forming machine featuring all-direction bending.

Another objective of the present invention is to provide a servo-rotating all-function tool module, which has a simple structure and may achieve stability of a downward pressing operation and a returning operation of a tool.

To achieve the above and other objectives, the present invention provides a servo-rotating all-function tool module for use with a spring forming machine, which is mountable to the spring forming machine to serve as an all-direction forming tool of the spring forming machine. The spring forming machine comprises a front wall board and a rotary axle assembly rotatably mounted to the front wall board. The tool module comprises an axle rotating tool module and a servo transmission module assembly.

In the servo-rotating all-function tool module, the axle rotating tool module is mounted on the rotary axle assembly and comprises an oscillating base and a tool. The oscillating base is rotatably mounted to the rotary axle assembly. The tool is mounted to an end of the oscillating base. The servo transmission module assembly is mounted to the spring forming machine and comprises a servo moving ring circumferentially surrounds the oscillating base to drive the oscillating base to oscillate in all directions so as to cause the tool to press down or lift upward.

In an embodiment, the rotary axle assembly comprises two support arms extending frontward and parallel to each other, a spring holding plate being provided between the two support arms, and the axle rotating tool module comprises an elastic element, the oscillating base, and the tool.

In this embodiment, the oscillating base comprises a first end and a second end, a shaft hole being formed between the first end and the second end to rotatably fix the oscillating base between the two support arms, the first end being located under the spring holding plate, the second end extending frontward through the servo moving ring and being provided with a tool seat. The elastic element is arranged between the first end of the oscillating base and the spring holding plate to provide a downward push force to the oscillating base. The tool is mounted to the tool seat of the oscillating base.

In an embodiment, the rotatable mounting of the oscillating base of the servo-rotating all-function tool module for use with the spring forming machine is such that an oscillation pin that is fixed between the two support arms is fit through the shaft hole of the oscillating base to rotatably fix the oscillating base between the two support arms.

In an embodiment, the oscillating base of the servo-rotating all-function tool module for use with the spring forming machine comprises a bearing rotatably mounted thereto to such that the servo moving ring abuts against the bearing to press down the second end of the oscillating base.

In an embodiment, the rotary axle assembly of the spring forming machine comprises two support arms extending frontward and parallel to each other. The two support arms comprise a spring holding plate arranged therebetween and a guide rail is arranged between the two support arms behind the spring holding plate. The axle rotating tool module of the servo-rotating all-function tool module for use with the spring forming machine further comprises a slide block, a spring, a top plate, and a CF-series bearing.

In this embodiment, the slide block is arranged on the guide rail between the two support arms and comprises a push end and a force acting end. The push end comprises an accommodation section formed in an underside thereof. The spring is accommodated in the accommodation section of the slide block to provide a lateral push force to the slide block. The top plate is mounted on the guide rail of the two support arms. The CF-series bearing is rotatably mounted to the force acting end of the slide block so that the servo moving ring abuts against the CF-series bearing to force the slide block to slide along the guide rail and the push end of the slide block is set against the bearing that is rotatably mounted to the oscillating base to drive the oscillating base to oscillate.

In an embodiment, the oscillating base of the servo-rotating all-function tool module for use with the spring forming machine comprises a slope surface formed thereon and the servo moving ring is provided with an inner slope surface arranged to extend circumferentially and corresponding to the slope surface formed on the oscillating base so that the servo moving ring is set, via the inner slope surface thereof, against the slope surface of the oscillating base to press down the second end of the oscillating base.

In an embodiment, the servo transmission module assembly of the servo-rotating all-function tool module for use with the spring forming machine comprises: a support bracket mounted to the front wall board at a location below the rotary axle assembly, a servomotor mounted to the support bracket and comprises a rotary shaft, a transmission shaft mounted to the rotary shaft to be driven by the rotary shaft to rotate, a bearing, a coupling seat comprising a guide block and a guide slot, a slide seat comprising a slide rail and a guide groove in communication with the slide rail, a slide block, and the servo moving ring.

In this embodiment, the transmission shaft comprises an eccentric shaft and the bearing is mounted to the eccentric shaft and received in the guide slot of the coupling seat so that the guide block arranged in the guide groove of the slide seat drives the slide block mounted to the guide block of the coupling seat to move along the slide rail of the slide seat mounted to the support bracket thereby driving the servo moving ring mounted to the slide block to drive the oscillating base the oscillate in all directions when the servomotor rotates thereby causing the tool to press down or lift upward.

In an embodiment, the servo transmission module assembly of the servo-rotating all-function tool module for use with the spring forming machine further comprises a bearing arranged between the rotary shaft of the servomotor and the support bracket to support the rotary shaft and eliminate potential swaying caused by the rotation of the servomotor.

In an embodiment, the servo transmission module assembly of the servo-rotating all-function tool module for use with the spring forming machine comprises: a support bracket mounted to a rear side of the front wall board, a servomotor mounted to the support bracket and comprising a rotary shaft, a transmission shaft mounted to the rotary shaft to be driven by the rotary shaft to rotate, a balance push bar comprising an upper end and a lower end, a cam slide seat mounted to the upper end of the balance push bar and comprising a guide rail, a bearing, at least two guide sleeves mounted to the front wall board, at least two guide posts respectively received through the at least two guide sleeves and having an end fixed to the upper end and the lower end of the balance push bar, and the servo moving ring.

In this embodiment, the transmission shaft comprises an eccentric shaft extending into the guide rail of the cam slide seat and the bearing is arranged between the guide rail and the eccentric shaft to drive the cam slide seat, the balance push bar, the at least two guide posts, and the servo moving ring mounted to an opposite end of the at least two guide posts to slide whereby when the servomotor rotates, the oscillating base can be driven to oscillate in all direction to cause the tool to press down or lift upward.

In summary, the present invention provides a servo-rotating all-function tool module for use with a spring forming machine and is applicable to all sorts of spring forming machines, wherein the direction in which a tool approaches a wire can be varied by rotating an axle in order to conduct operations such as bending at different angles and twisting/looping to achieve a function that is generally achievable with a high-end spring forming machine featuring all-direction bending. Further, since an oscillating base is driven by a servo moving ring of a servo transmission module assembly to conduct an oscillation operation in all directions, the structural design is simple and can still meet the needs for stability of a tool in an operation of pressing down or return.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
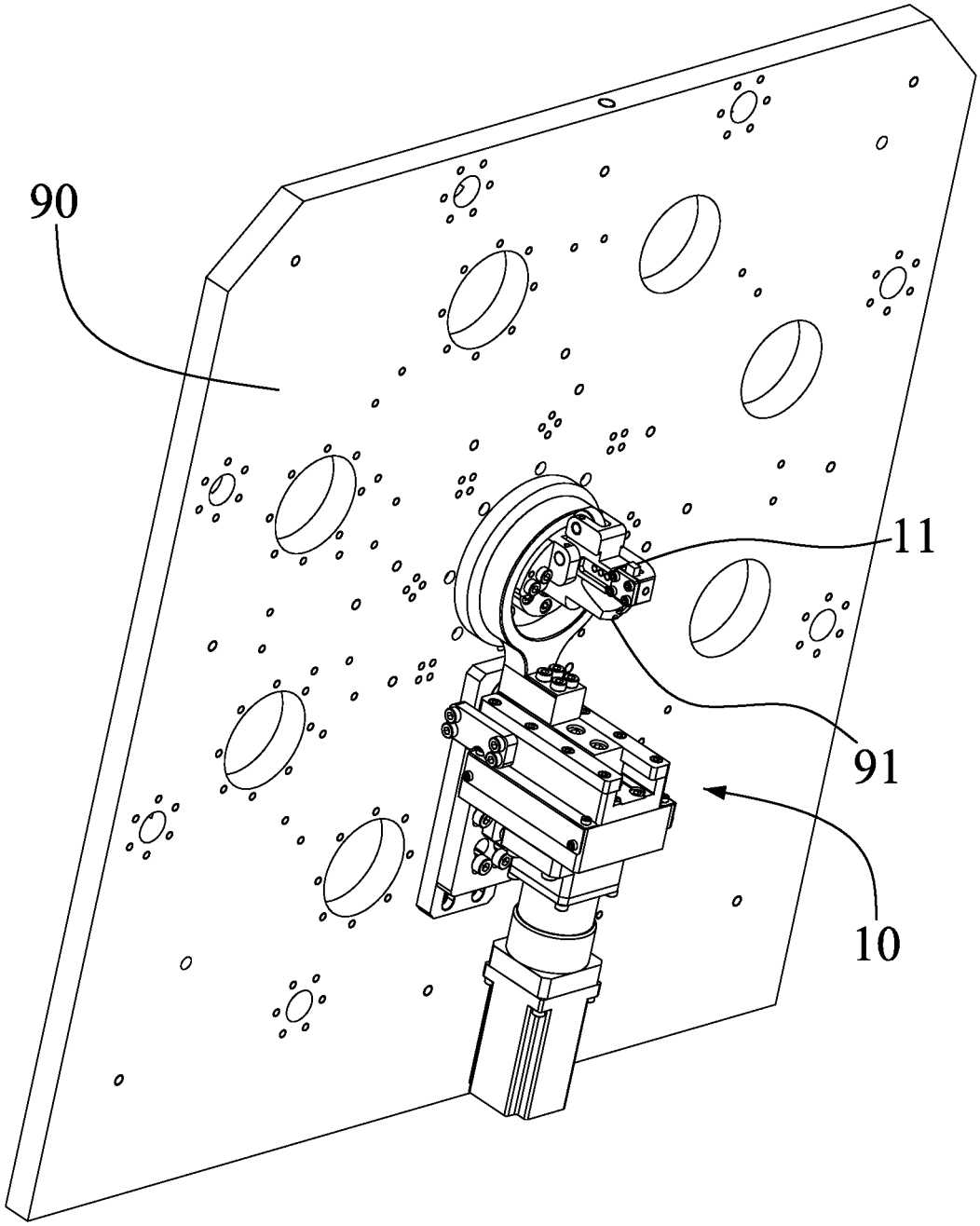
FIG. 1 is a perspective view showing a servo-rotating all-function tool module according to a first embodiment of the present invention mounted in a spring forming machine.
Figure 2:
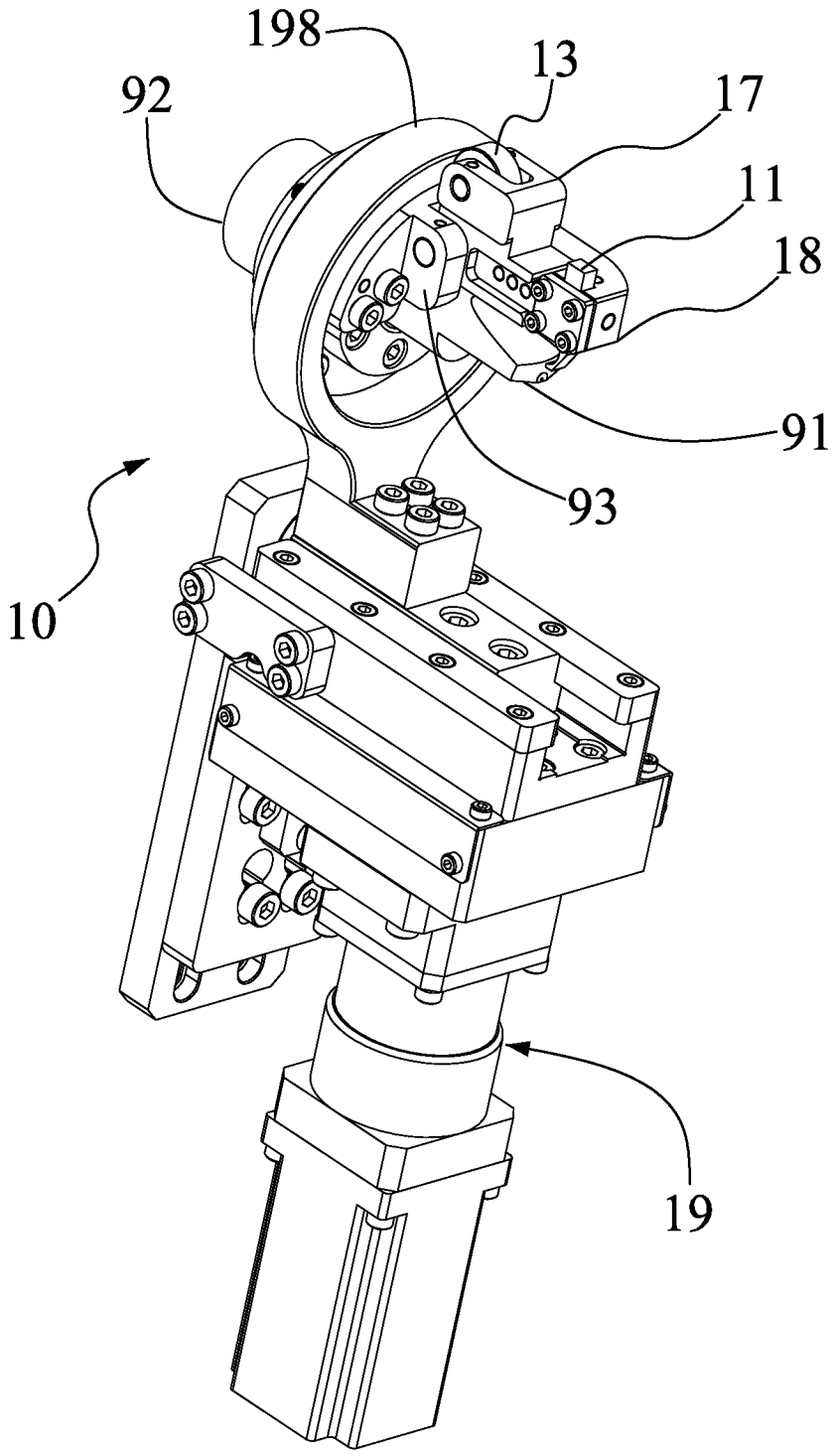
FIG. 2 is a perspective view illustrating a tool module and a rotary axle assembly of FIG. 1 in an assembled form.
Figure 3:
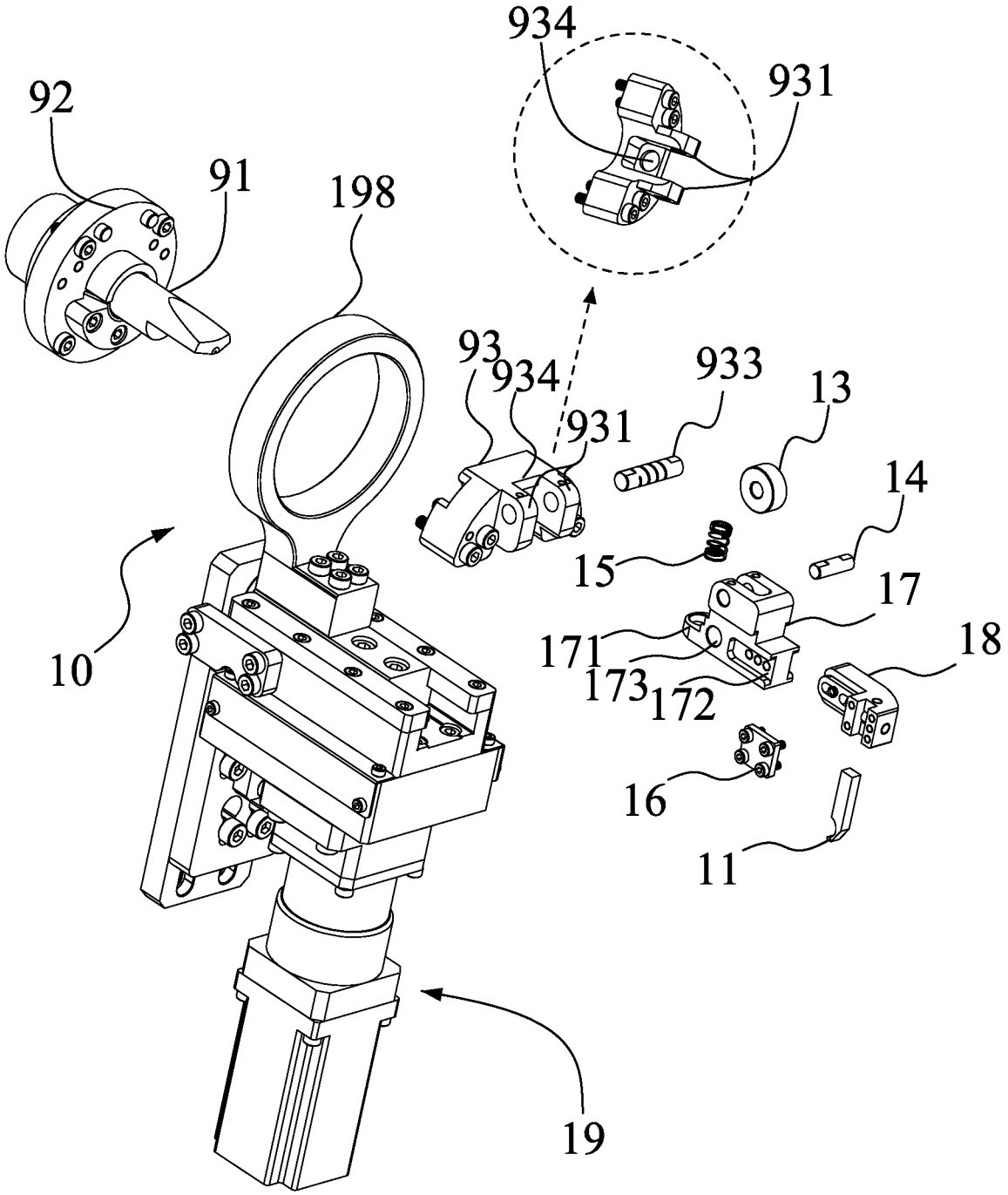
FIG. 3 is a partly exploded view of FIG. 2.

Referring to FIGS. 1-3, which are respectively a schematic view showing a servo-rotating all-function tool module according to a first embodiment of the present invention mounted in a spring forming machine and an assembled view and an exploded view showing a tool module and a rotary axle assembly of FIG. 1.

As shown in the drawings, the spring forming machine comprises a front wall board 90, a rotary axle assembly rotatably mounted to the front wall board 90. The rotary axle assembly comprises an axle retention seat 92 and an axle 91 mounted to the axle retention seat 92. The axle retention seat 92 comprises an oscillation retention seat 93 mounted to a front side thereof. The oscillation retention seat 93 is extended frontward to form two support arms 931 that are parallel to each other. A spring holding plate 934 is provided between the two support arms 931. The tool module 10 comprises a tool 11 that is mounted, in combination with the axle 91 of the rotary axle assembly, to the front wall board 90 of the spring forming machine in a rotatable manner such that through rotation of the rotary axle assembly mounted to the front wall board 90 of the spring forming machine, a direction in which a tool 11, such as a bending tool, of the tool module 10 is moved to approach a wire can be varied so as to achieve a function of all-direction bending of the wire without the need to rotate the wire whereby the tool is not subject to the same constraints of other tools (not shown) directly mounted to the front wall board 90 of the spring forming machine that are allow to conduct or perform a bending operation or other functions with a fixed angle due to installation angles thereof.

In the drawings, the tool module 10 comprises a servo transmission module assembly 19, which comprises a servo moving ring 198, and an axle rotating tool module, which comprises an oscillating base 17, an elastic element 15, which can be for example a spring, a bearing 13, the tool 11, and a tool seat 18.

The oscillating base 17 comprises a first end 171 and a second end 172. Formed between the first end 171 and the second end 172 is a shaft hole 173, such that an oscillation pin 933 that is fixed between the two support arms 931 and is fit through the shaft hole 173 of the oscillating base 17 to rotatably fix the oscillating base 17 between the two support arms 931 of the oscillation retention seat 93. The first end 171 of the oscillating base 17 is located under the spring holding plate 934 and the second end 172 extends frontward through the servo moving ring 198.

Arranged between the first end 171 of the oscillating base 17 and the spring holding plate 934 is the elastic element 15, which provides a downward push force to the oscillating base 17, while the second end 172 is provided with the tool seat 18. An end of the tool seat 18 receives a tool holding plate 16 mounted thereto in order to allow the tool 11 to be mounted to the tool seat 18 of the second end 172 of the oscillating base 17. The oscillating base 17 comprises a bearing pin 14 that is mounted on a top part thereof to rotatably support and fix the bearing 13.

Thus, when the servo transmission module assembly 19 mounted to the spring forming machine drives the servo moving ring 198 to slide frontward along the axle 91, the servo moving ring 198 abuts against and applies a force to the bearing 13 to drive the oscillating base 17 to oscillate and thus control the tool 11 to perform a downward pressing operation. Or, alternatively, when the servo transmission module assembly 19 mounted to the spring forming machine drives the servo moving ring 198 to slide rearwards along the axle 91, the downward push force that the elastic element 15 applies to the first end 171 of the oscillating base 17 makes the tool 11 that is mounted to the second end 172 of the oscillating base 17 move upwards.

Figure 4:
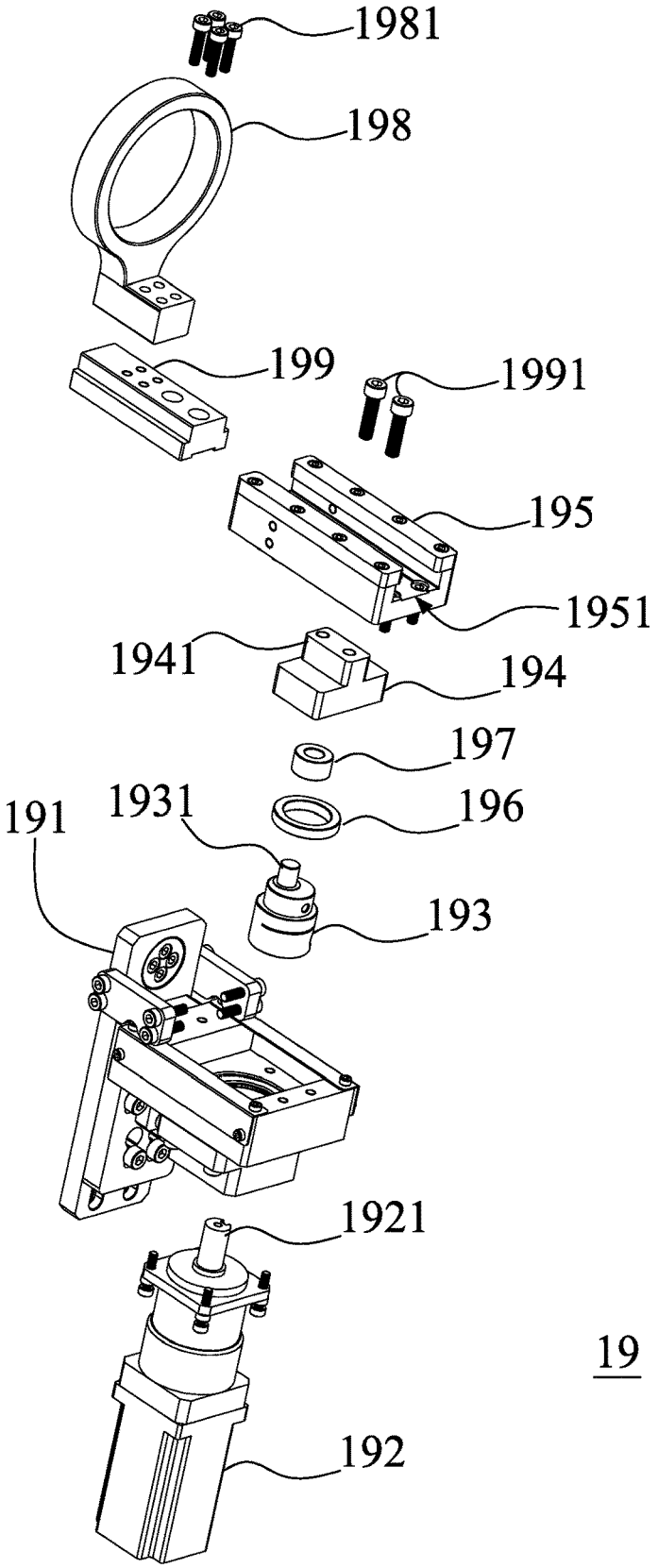
FIG. 4 is an exploded view of a servo transmission module assembly of FIG. 2.
Figure 5:
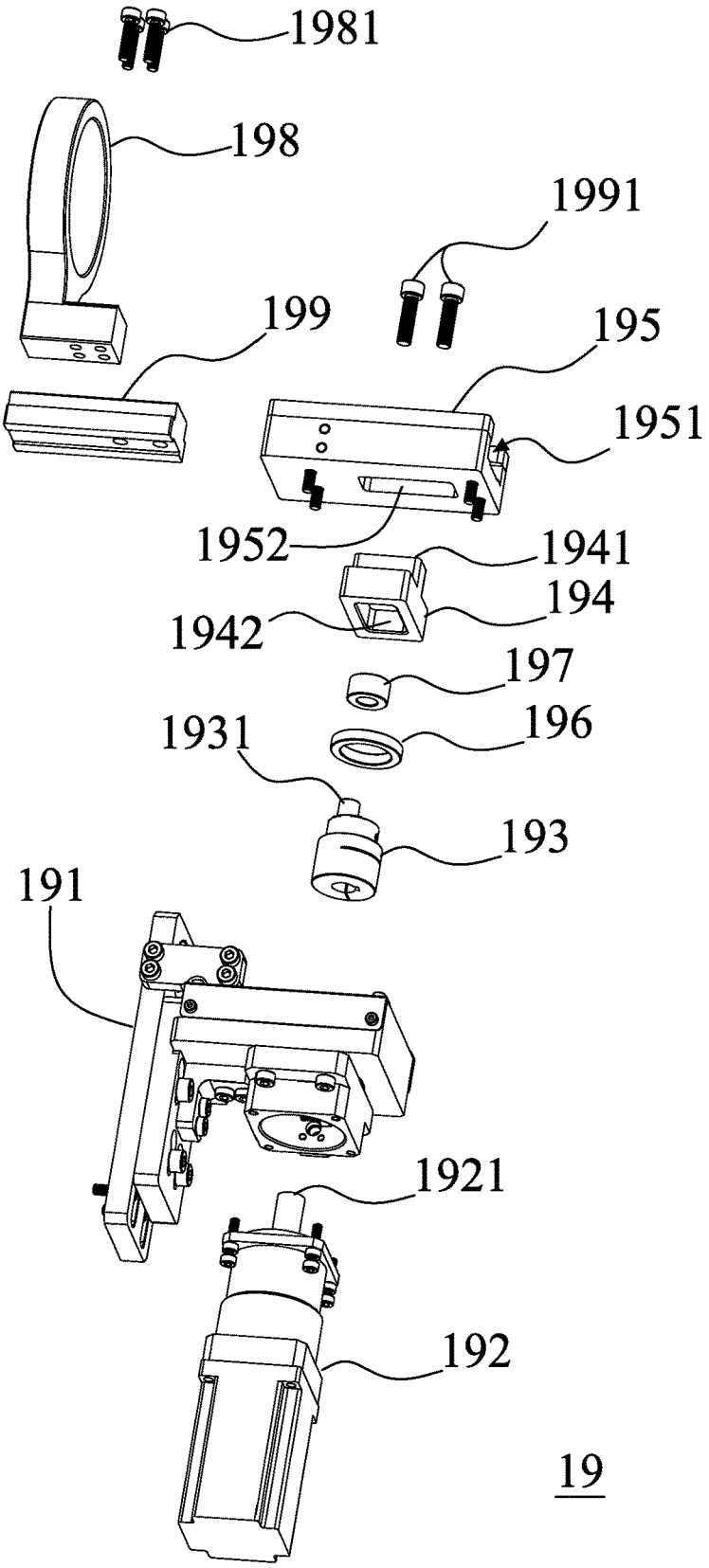
FIG. 5 is an exploded view of the servo transmission module assembly of FIG. 2, taken from a different angle.

As shown in FIGS. 4 and 5, in addition to the servo moving ring 198, the servo transmission module assembly 19 also comprises a support bracket 191 that is mounted to the front wall board 90 at a location below the axle 91 of the rotary axle assembly, a servomotor 192 that is mounted to the support bracket 191 and comprises for example a speed reducer, a transmission shaft 193 that is mounted to a rotary shaft 1921 of the servomotor 192 and is driven by the rotary shaft 1921 to rotate, a bearing 197, a coupling seat 194 that comprises a guide block 1941 and guide slot 1942, a slide seat 195 that comprises a slide rail 1951 and a guide groove 1952 in communication with the slide rail 1951, and a slide block 199.

The transmission shaft 193 comprises an eccentric shaft 1931 and the bearing 197 is rotatably mounted on the eccentric shaft 1931 and received in the guide slot 1942 of the coupling seat 194 such that the guide block 1941 of the coupling seat 194 that is arranged in the guide groove 1952 of the slide seat 195 drives the slide block 199 that is mounted by bolts 1991 to the guide block 1941 of the coupling seat 194 to slide along the slide rail 1951 of the slide seat 195 that is mounted to the support bracket 191, whereby the servo moving ring 198 that is mounted by bolts 1981 to the slide block 199 to take a stable sliding movement along the axle 91 frontwards and rearwards. To eliminate potential swaying caused by the rotation of the servomotor 192, a bearing 196 is arranged between the rotary shaft 1921 of the servomotor 192 and the support bracket 191.

Figure 6:
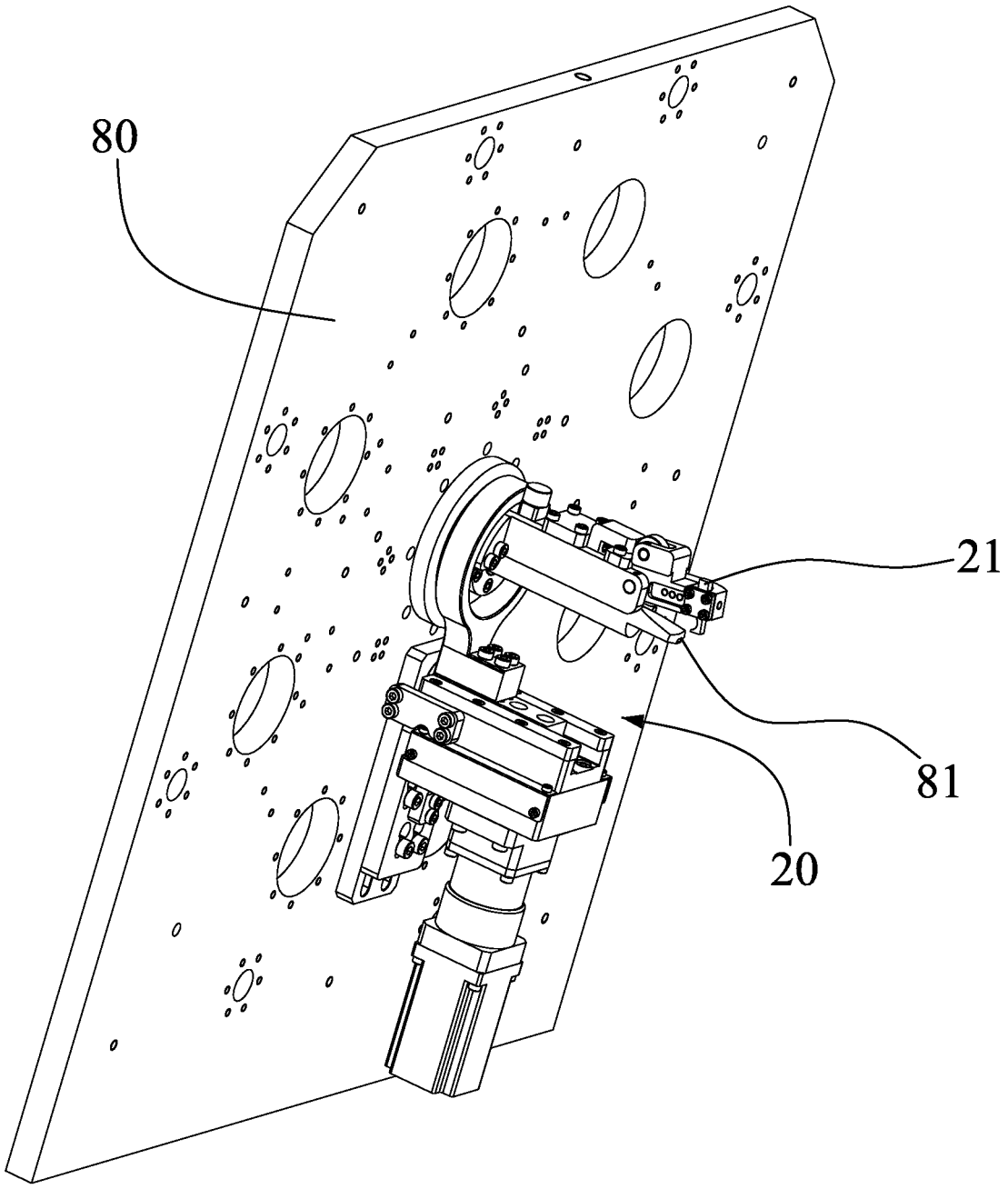
FIG. 6 is a perspective view showing a servo-rotating all-function tool module according to a second embodiment of the present invention mounted in a spring forming machine.
Figure 7:
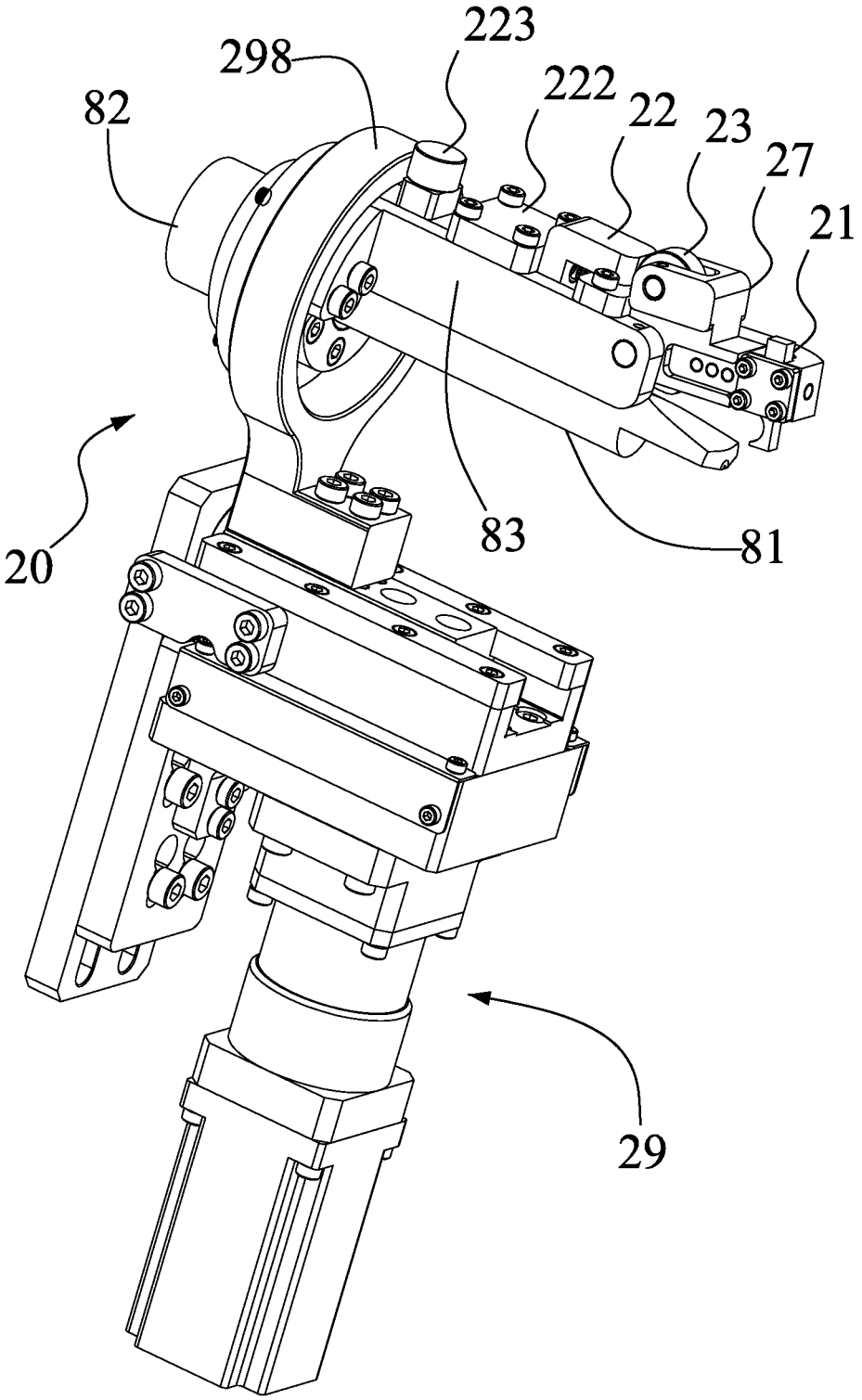
FIG. 7 is a perspective view illustrating a tool module and a rotary axle assembly of FIG. 6 in an assembled form.
Figure 8:
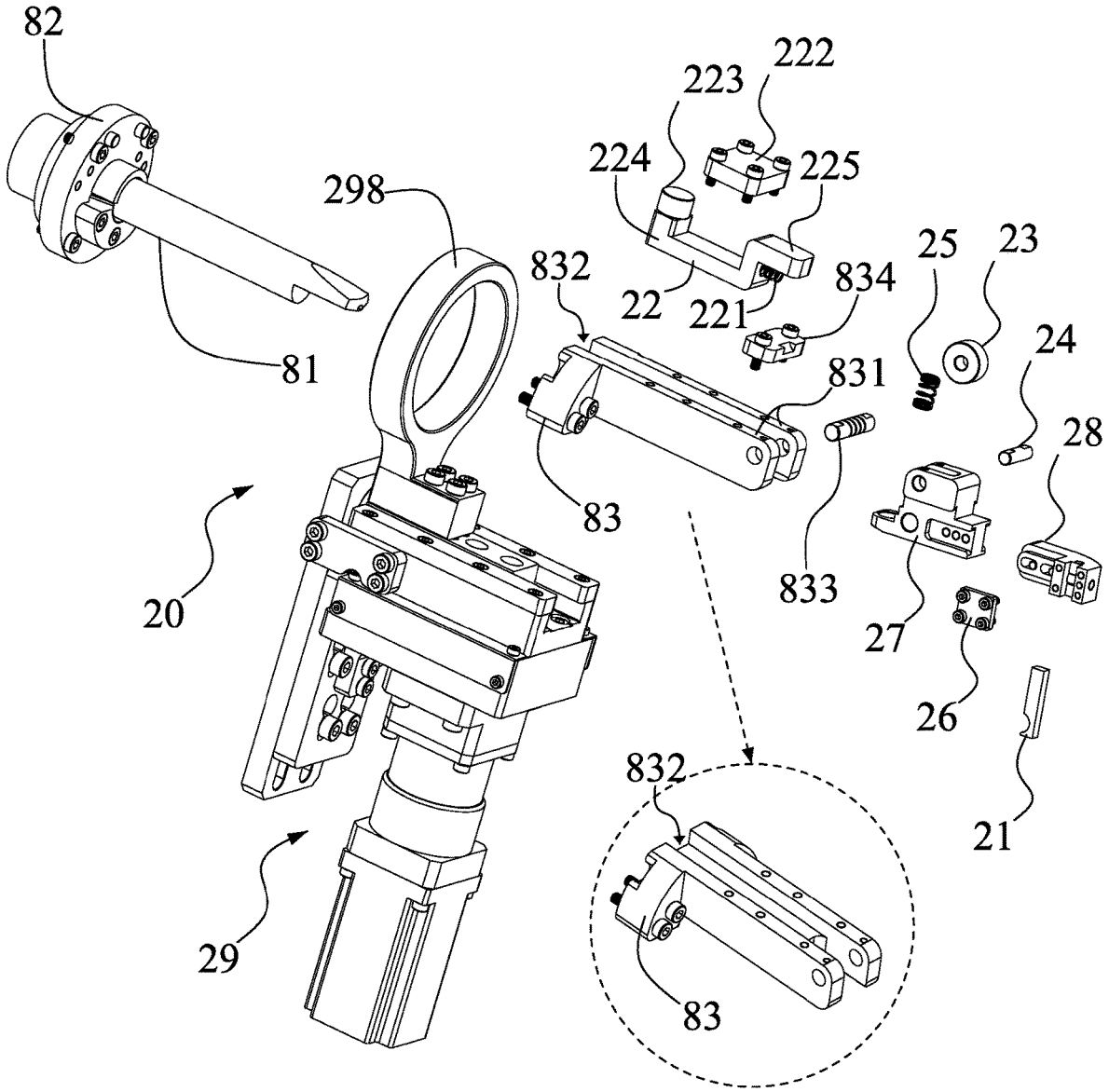
FIG. 8 is a partly exploded view of FIG. 7.

Referring to FIGS. 6-8, which are respectively a perspective view showing a servo-rotating all-function tool module according to a second embodiment of the present invention mounted in a spring forming machine and an assembled view and an exploded view showing a tool module and a rotary axle assembly of FIG. 6.

As shown in the drawings, the spring forming machine comprises a rotary axle assembly rotatably mounted to the front wall board 80 and the rotary axle assembly comprises an axle retention seat 82 and an axle 81 mounted to the axle retention seat 82. The axle retention seat 82 comprises an oscillation retention seat 83 mounted to a front side thereof. The oscillation retention seat 83 is extended frontward to form two support arms 831 that are parallel to each other. An oscillation pin 833 extends through and is mounted to front ends of the two support arms 831. The tool module 20 comprises, similar to the first embodiment, an oscillating base 27, an elastic element 25, which can be for example a spring, a bearing 23, a bearing pin 24, a tool 21, a tool holding plate 26, a tool seat 28, a servo transmission module assembly 29.

What is different from the first embodiment is that the two support arms 831 extended frontward from the oscillation retention seat 83 is elongated to accommodate the length of the axle 81 and the two support arms 831 comprise a guide rail 832 arranged therebetween and a spring holding plate 834 mounted between front ends thereof. The axle rotating tool module 20 further comprises a slide block 22 arranged on the guide rail 832, a spring 221, a top plate 222, and a CF-series bearing 223.

The slide block 22 comprises a push end 225 and a force acting end 224. The push end 225 comprises an accommodation section formed in an underside thereof for accommodating the spring 221 so that the spring 221 is set in engagement with the oscillating base 27 to provide a lateral push force to the slide block 22. The top plate 222 is mounted on the guide rail 832 of the two support arms 831. The CF-series bearing 223 is rotatably mounted to the force acting end 224 of the slide block 22 so that the servo moving ring 298 abuts against the CF-series spring 223 to force the slide block 22 to slide along the guide rail 832 and thus, the push end 225 of the slide block 22 is set against the bearing 23 that is rotatably mounted to the oscillating base 27 to drive the oscillating base 27 to oscillate and thus causing the tool 21 that is mounted to the second end of the oscillating base 27 to press down or to lift upward.

Figure 9:
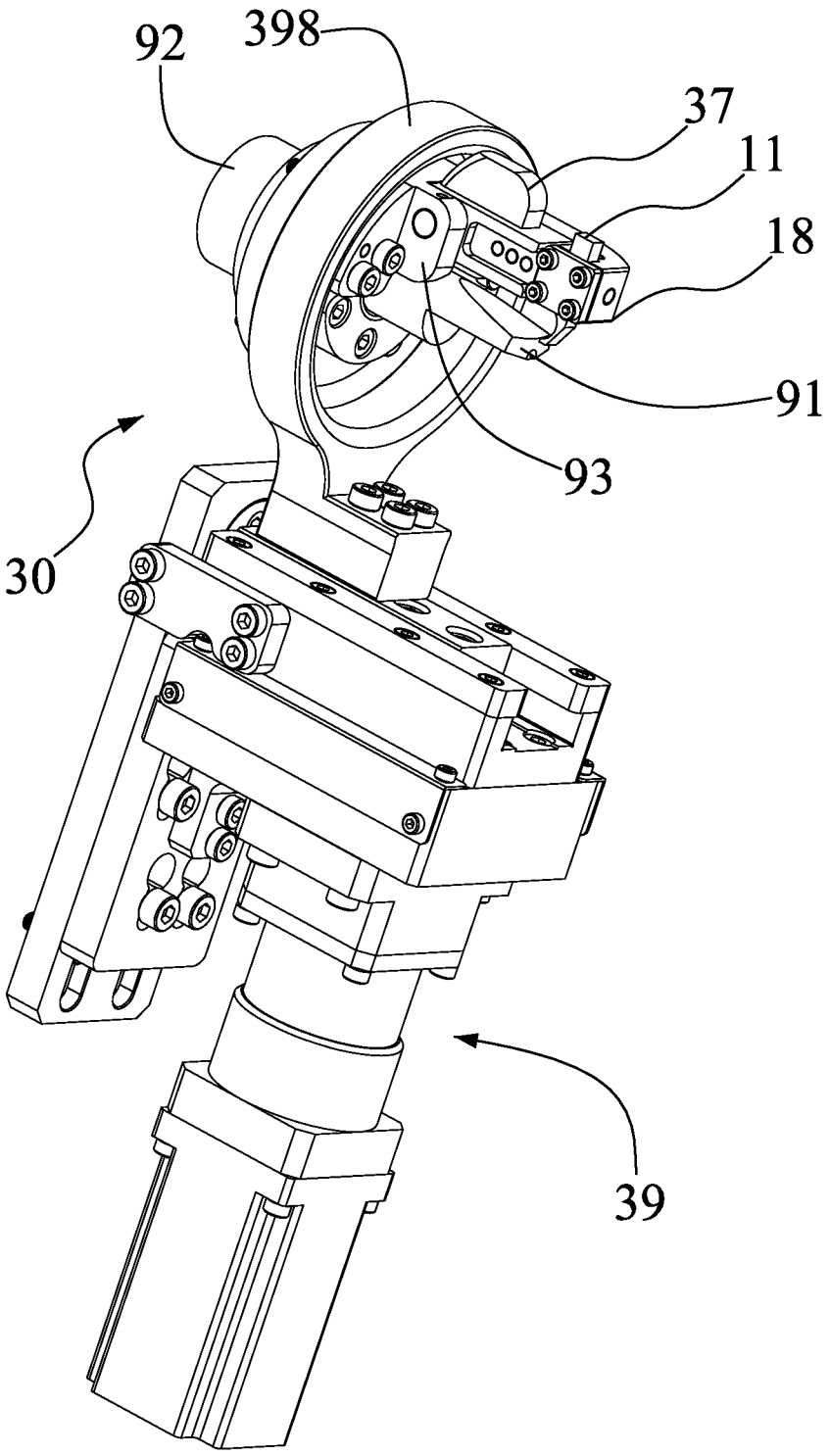
FIG. 9 is a perspective view showing a servo-rotating all-function tool module according to a third embodiment of the present invention and a rotary axle assembly in an assembled form.
Figure 10:
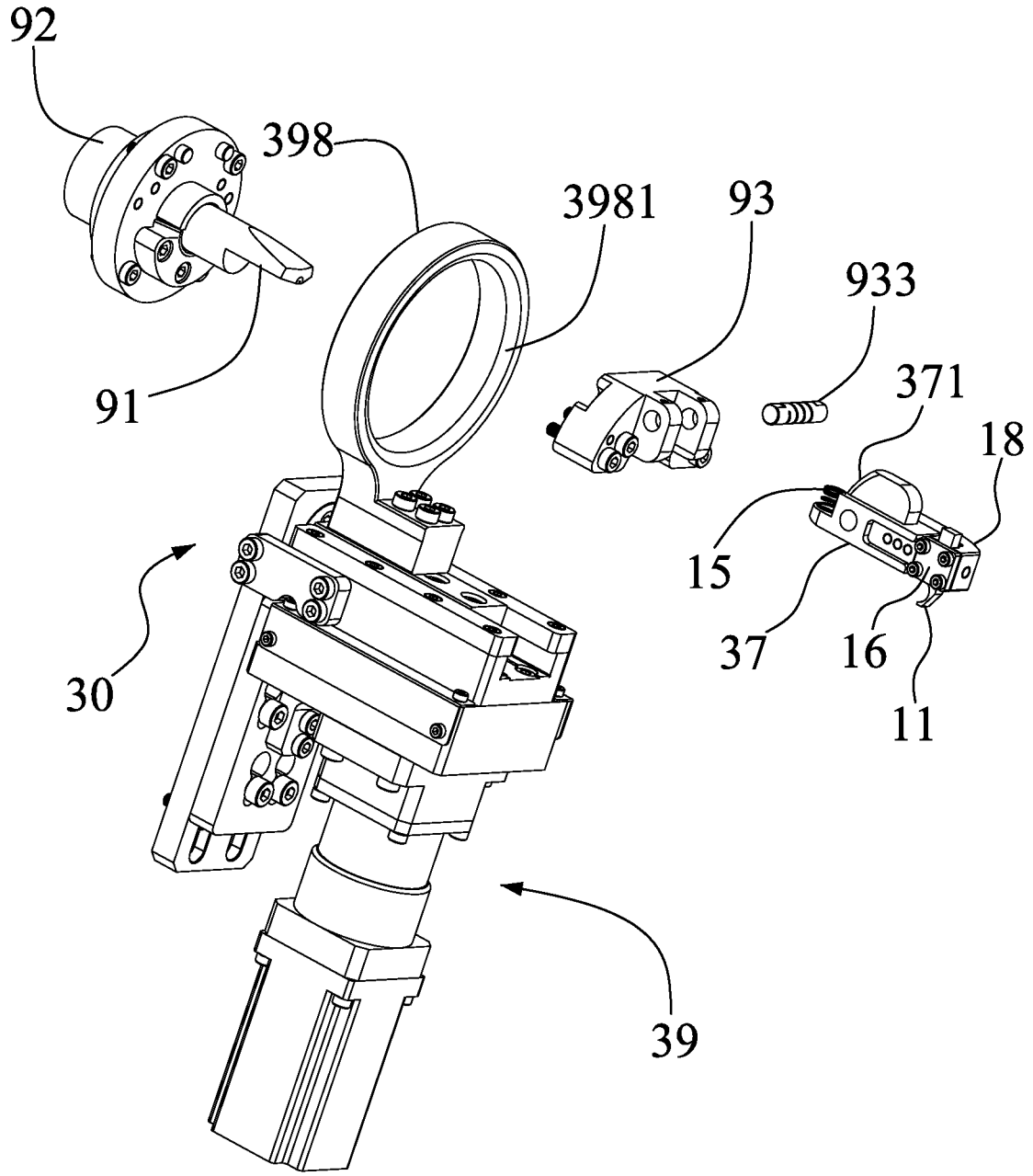
FIG. 10 is a partly exploded view of FIG. 9.

Referring to FIGS. 9 and 10, which are respectively assembled view and an exploded view showing a servo-rotating all-function tool module according to a third embodiment of the present invention and a rotary axle assembly, in the instant embodiment, the axle retention seat 92, the axle 91, the oscillation retention seat 93, the oscillation pin 933 of the spring forming machine and the elastic element 15, which can be for example a spring, the tool 11, the tool holding plate 16, the tool seat 18 of the axle rotating tool module of the tool module 30 are identical to those of the first embodiment and in addition, the servo transmission module assembly 39 is structurally identical to the servo transmission module assembly 19 of the first embodiment, except the servo moving ring 398, so that repeated description will be omitted.

What is different from the first embodiment is that in the instant embodiment, the oscillating base 37 of the axle rotating tool module of the tool module 30 is not provided with the bearing 13 of the first embodiment and instead, the oscillating base 37 is provided with a slope surface 371, and the servo moving ring 398 of the servo transmission module assembly 39 is provided with an inner slope surface 3981 that is arranged to extend circumferentially and corresponds to the slope surface 371 so that the servo moving ring 398 is set, via the inner slope surface 3981 thereof, against the slope surface 371 of the oscillating base 37 to drive the oscillating base 37 to oscillate so as to cause the tool 11 at the second end of the oscillating base 37 to press down or lift upward.

Figure 11:
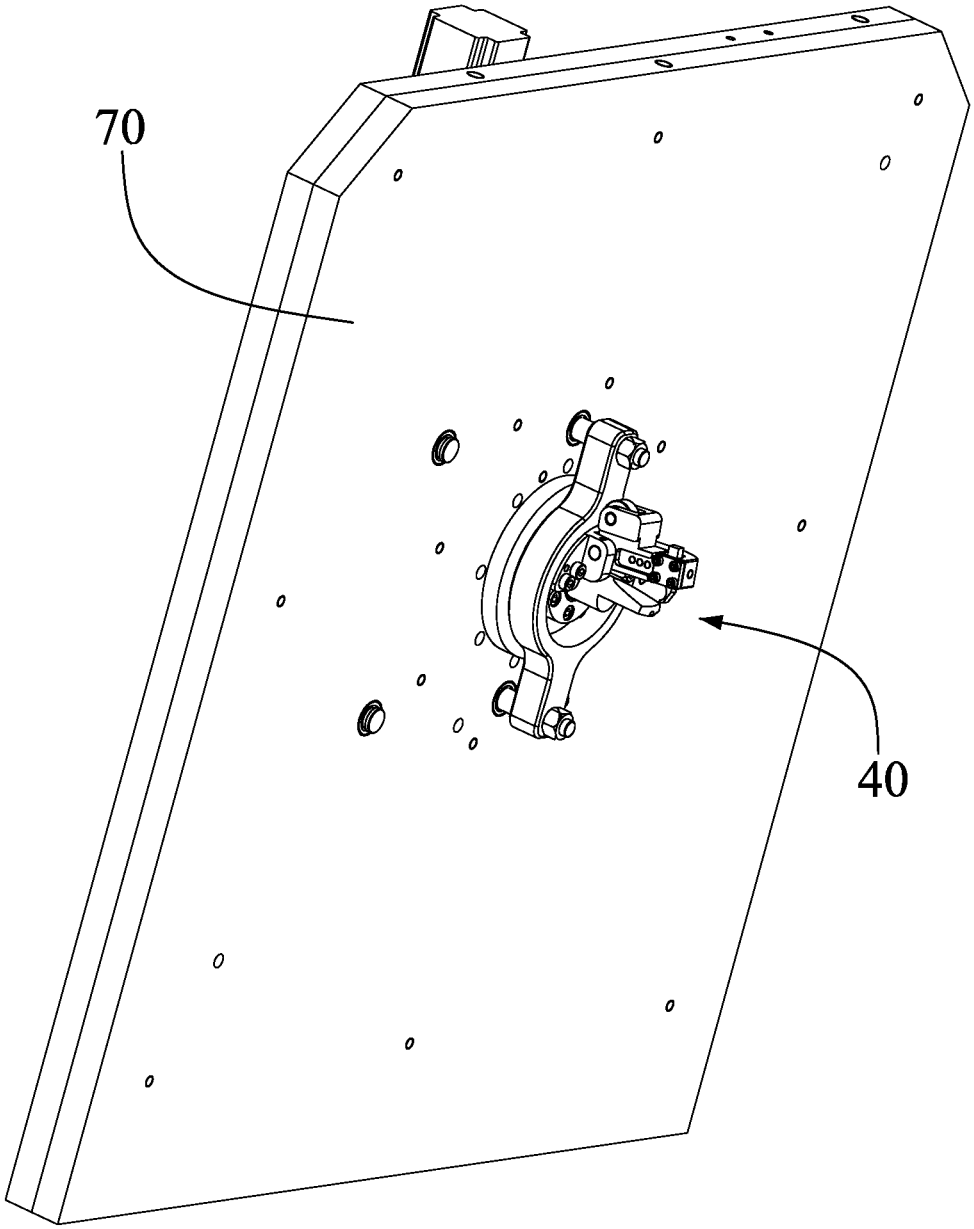
FIG. 11 is a perspective view showing a servo-rotating all-function tool module according to a fourth embodiment of the present invention mounted in a spring forming machine.
Figure 12:
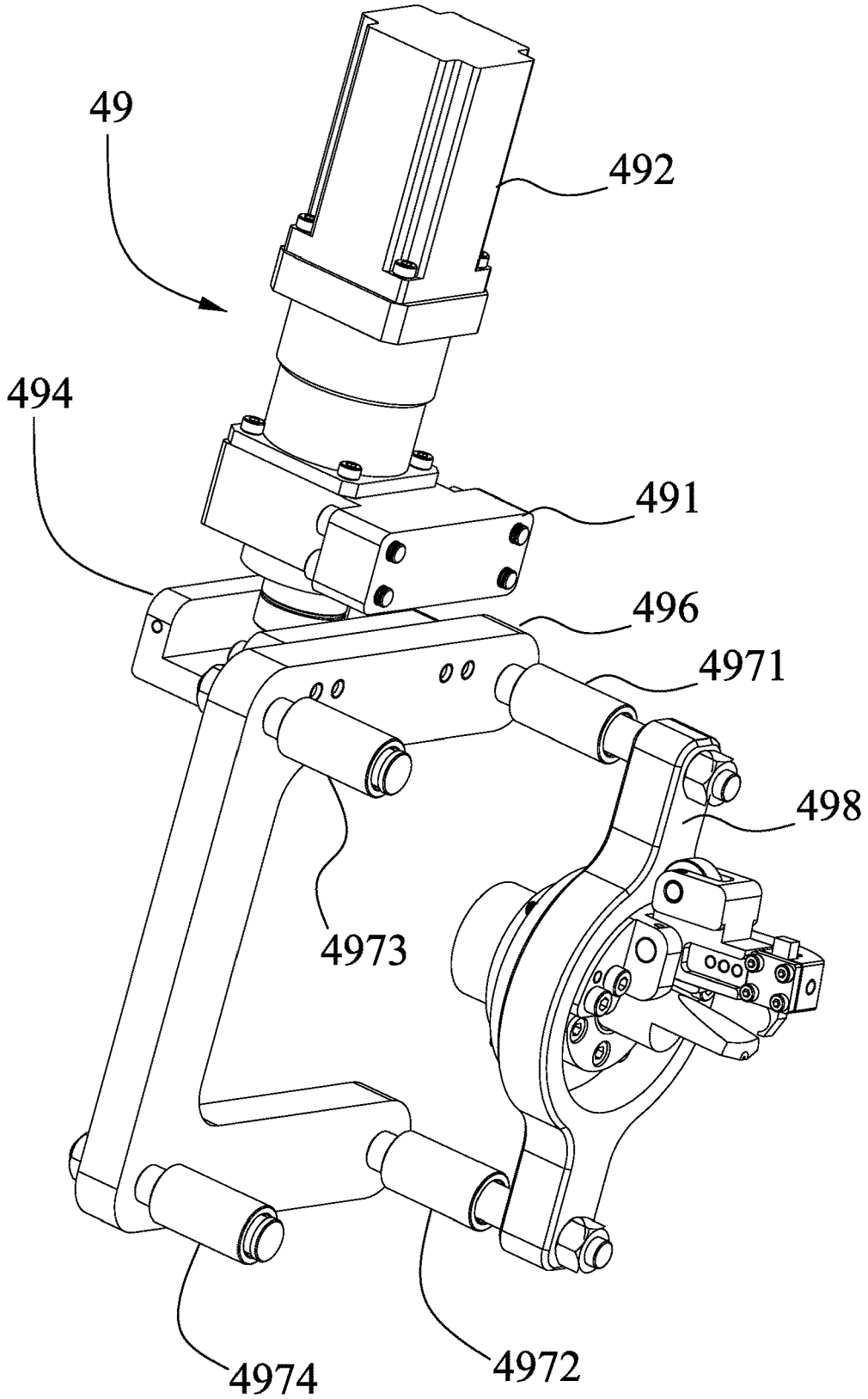
FIG. 12 is a perspective view illustrating a tool module and a rotary axle assembly of FIG. 11 in an assembled form.
Figure 13:
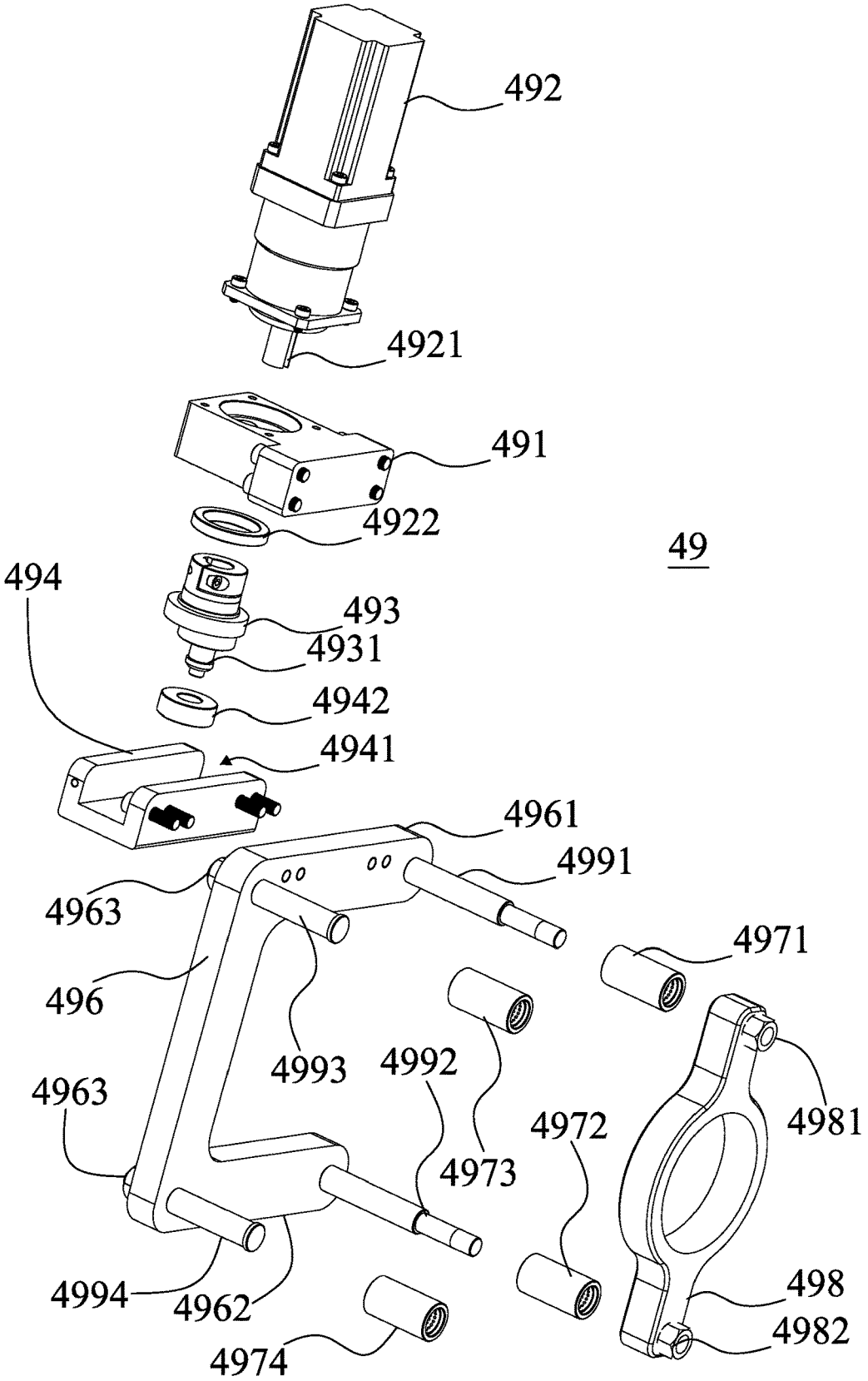
FIG. 13 is an exploded view illustrating a servo transmission module assembly of FIG. 12.

Referring to FIGS. 11-13, which are respectively a schematic view showing a servo-rotating all-function tool module according to a third embodiment of the present invention mounted in a spring forming machine and an assembled view and an exploded view showing a servo transmission module assembly of FIG. 11, in the drawings, the tool module 40 comprises a servo transmission module assembly 49 that has a structure different from that of the first embodiment, and an axle rotating tool module that has a structure similar to that of the first embodiment so that repeated description will be omitted.

As shown in the drawings, the servo transmission module assembly 49 comprises a support bracket 491 that is mounted to a rear side of the front wall board 70, a servomotor 492, which is mounted to the support bracket 491 and comprises a rotary shaft 4921 and of which an example may comprise a speed reducer, a transmission shaft 493 that is mounted to the rotary shaft 4921 and is driven by the rotary shaft 4921 to rotate, a balance push bar 496 having an upper end 4961 and a lower end 4962, a cam slide seat 494 mounted to the upper end 4961 of the balance push bar 496 and comprises a guide rail 4941, a bearing 4942, guide sleeves 4971, 4972, 4973, 4974 mounted to the front wall board 70, guide posts 4991, 4992, 4993, 4994 respectively received through the guide sleeve 4971, 4972, 4973, 4974 and each having an end fixed by a nut 4963 to the upper end 4961 and the lower end 4962 of the balance push bar 496, and a servo moving ring 498 having two ends respectively fixed by nuts 4981, 4982 to an opposite end of the guide posts 4991, 4992.

The transmission shaft 493 comprises an eccentric shaft 4931 extending into the guide rail 4941 of the cam slide seat 494. The bearing 4942 is arranged between the eccentric shaft 4931 and the guide rail 4941 of the cam slide seat 494. When the servomotor 492 rotates, the bearing 4942 that is arranged between the guide rail 4941 and the eccentric shaft 4931 drives the cam slide seat 494, the balance push bar 496, the guide posts 4991, 4992, 4993, 4994, and the servo moving ring 498 to slide for driving the oscillating base 17 to oscillate in all directions so as to cause the tool 11 to press down or lift upward. To eliminate potential swaying caused by the rotation of the servomotor 492, a bearing 4922 is arranged between the rotary shaft 4921 of the servomotor 492 and the support bracket 491.

Figure 14:
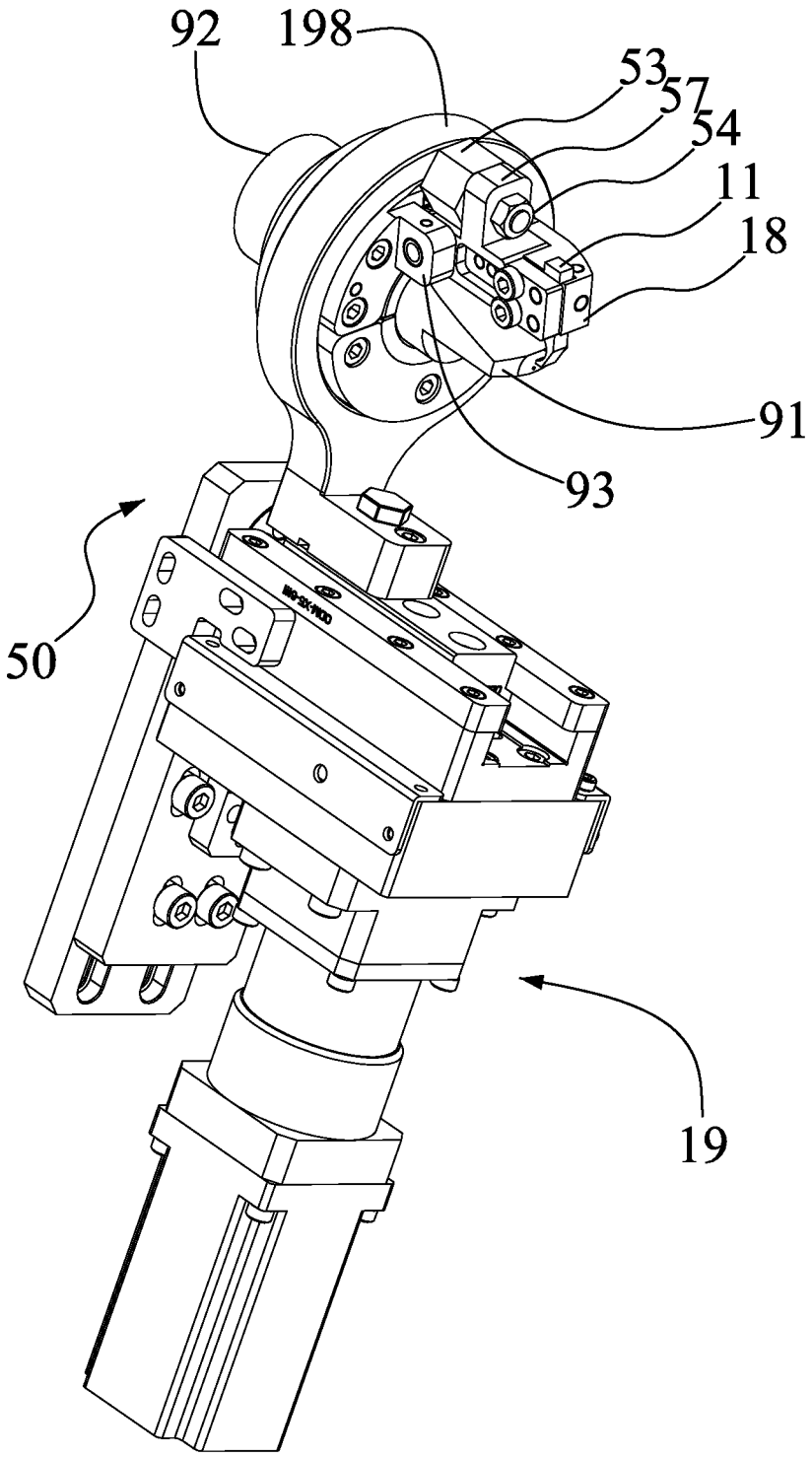
FIG. 14 is a perspective view illustrating a rotary axle assembly and a servo-rotating all-function tool module according to a fifth embodiment of the present invention in an assembled form.
Figure 15:
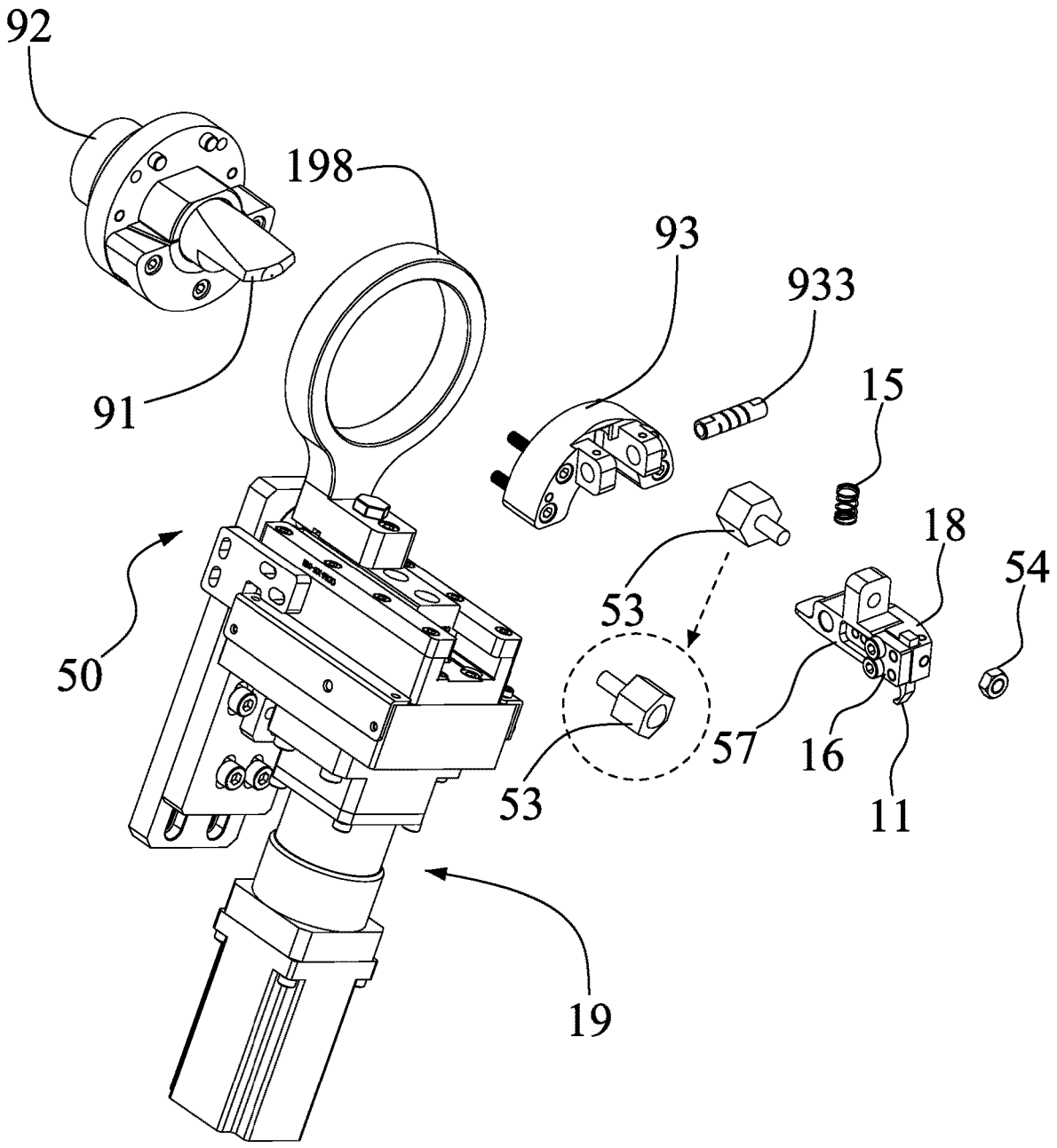
FIG. 15 is an exploded view of a portion of FIG. 14.

Referring to FIGS. 14 and 15, which are respectively a perspective view illustrating a rotary axle assembly and a servo-rotating all-function tool module according to a fifth embodiment of the present invention in an assembled form and an exploded view thereof, in the instant embodiment, the axle retention seat 92, the axle 91, the oscillation retention seat 93, the oscillation pin 933 of the spring forming machine and the elastic element 15, which can be for example a spring, the tool 11, the tool holding plate 16, the tool seat 18 of the axle rotating tool module of the tool module 50 are similar to those of the first embodiment and in addition, the servo transmission module assembly 19 is also similar to that of the first embodiment, so that repeated description will be omitted.

What is different from the first embodiment is that in the instant embodiment, the oscillating base 57 of the axle rotating tool module of the tool module 50 is not provided, in a rotatable manner, with the bearing 13 of the first embodiment and instead, a nut 54 fastened to a universal bearing 53 mounted to the oscillating base 57 is provided as substitute so that a driving force that the servo moving ring 198 pushes against the universal bearing 53 drives the oscillating base 37 to oscillate, in all directions, so as to cause the tool 11 at the second end of the oscillating base 57 to press down or lift upward.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

We claim:

1. A servo-rotating multi-function tool module, which is adapted to be mounted to a spring forming machine to serve as an multi-direction forming tool of the spring forming machine, wherein the spring forming machine comprises a front wall board and a rotary axle assembly rotatably mounted to the front wall board, comprising:

an axle rotating tool module, which is mounted on the rotary axle assembly and comprises an oscillating base and a tool, the oscillating base being rotatably mounted to the rotary axle assembly, the tool being mounted to an end of the oscillating base; and a servo transmission module assembly, which is mounted to the spring forming machine and comprises a servo moving ring circumferentially surrounds the oscillating base to drive the oscillating base to oscillate in multiple directions so as to cause the tool to press down or lift upward;

wherein the rotary axle assembly comprises two support arms extending frontward and parallel to each other, a spring holding plate being provided between the two support arms, the axle rotating tool module comprising:

the oscillating base, which comprises a first end and a second end, a shaft hole being formed between the first end and the second end to rotatably fix the oscillating base between the two support arms, the first end being located under the spring holding plate, the second end extending frontward through the servo moving ring and being provided with a tool seat;

an elastic element, which is arranged between the first end of the oscillating base and the spring holding plate to provide a downward push force to the oscillating base; and the tool, which is mounted to the tool seat of the oscillating base.

2. The servo-rotating multi-function tool module according to claim 1, wherein an oscillation pin that is fixed between the two support arms is fit through the shaft hole of the oscillating base to rotatably fix the oscillating base between the two support arms.

3. The servo-rotating multi-function tool module according to claim 1, wherein the oscillating base comprises a bearing rotatably mounted thereto to such that the servo moving ring abuts against the bearing to press down the second end of the oscillating base.

4. The servo-rotating multi-function tool module according to claim 3, wherein the two support arms comprises a guide rail arranged therebetween and the axle rotating tool module further comprises:

a slide block, which is arranged on the guide rail and comprises a push end and a force acting end, the push end comprising an accommodation section formed in an underside thereof;

a spring, which is accommodated in the accommodation section to provide a lateral push force to the slide block;

a top plate, which is mounted on the guide rail of the two support arms; and a CF-series bearing, which is rotatably mounted to the force acting end of the slide block so that the servo moving ring abuts against the CF-series bearing to force the slide block to slide along the guide rail and the push end of the slide block is set against the bearing that is rotatably mounted to the oscillating base to drive the oscillating base to oscillate.

5. The servo-rotating multi-function tool module according to claim 1, wherein the oscillating base is provided with a slope surface and the servo moving ring of the servo transmission module assembly is provided with an inner slope surface that is arranged to extend circumferentially and corresponds to the slope surface so that the servo moving ring is set, via the inner slope surface thereof, against the slope surface of the oscillating base to press down the second end of the oscillating base.

6. The servo-rotating multi-function tool module according to claim 1, wherein the oscillating base is provided with a universal bearing mounted thereon so that the servo moving ring is allowed to push against the universal bearing to press down the second end of the oscillating base.

7. The servo-rotating multi-function tool module according to claim 1, wherein the servo transmission module assembly comprises:

a support bracket, which is mounted to the front wall board at a location below the rotary axle assembly;

a servomotor, which is mounted to the support bracket and comprises a rotary shaft;

a transmission shaft, which is mounted to the rotary shaft to be driven by the rotary shaft to rotate, the transmission shaft comprising an eccentric shaft;

a bearing, which is rotatably mounted on the eccentric shaft;

a coupling seat, which comprises a guide block and a guide slot, the guide slot receiving the bearing therein;

a slide seat, which is mounted to the support bracket and comprises a slide rail and a guide groove in communication with the slide rail, the guide block of the coupling seat is arranged in the guide groove;

a slide block, which is mounted to the guide block of the coupling seat and is slidable along the slide rail; and the servo moving ring, which is mounted to the slide block in order to drive the oscillating base to oscillate in multiple directions when the servomotor rotates to thereby cause the tool to press down or lift upward.

8. The servo-rotating multi-function tool module according to claim 7, wherein a bearing is arranged between the rotary shaft and the support bracket.

9. The servo-rotating multi-function tool module according to claim 1, wherein the servo transmission module assembly comprises:

a support bracket, which is mounted to a rear side of the front wall board;

a servomotor, which is mounted to the support bracket and comprises a rotary shaft;

a balance push bar, which comprises an upper end and a lower end;

a cam slide seat, which is mounted to the upper end of the balance push bar and comprises a guide rail;

a transmission shaft, which is mounted to the rotary shaft and is driven by the rotary shaft to rotate, the transmission shaft comprising an eccentric shaft extending into the guide rail;

a bearing, which is arranged between the eccentric shaft and the guide rail;

at least two guide sleeves, which are mounted to the front wall board;

at least two guide posts, which are respectively received through the at least two guide sleeves and having an end fixed to the upper end and the lower end of the balance push bar; and the servo moving ring, which is fixed to an opposite end of the at least two guide posts in order to drive the oscillating base to oscillate in multiple directions when the servomotor rotates to thereby cause the tool to press down or lift upward.

10. The servo-rotating multi-function tool module according to claim 9, wherein a bearing is arranged between the rotary shaft and the support bracket.

* * * * *